US012687024B2

(12) United States Patent
Rouif et al.

(10) Patent No.: US 12,687,024 B2
(45) Date of Patent: Jul. 21, 2026

(54) POST FOR SECURING A PANEL, AND FRENCH-STYLE BALCONY, PRIVACY SCREEN OR SUNSHADE COMPRISING SUCH A POST

(71) Applicant: SB INGENIERIE, Poisy (FR)

(72) Inventors: Léandre Rouif, Epagny (FR); Romain Chapel, Saint Sylvestre (FR); Sylvianne Giacometti, Choisy (FR)

(73) Assignee: SB INGENIERIE, Poisy (FR)

( * ) Notice: Subject to any disclaimer, the term of this patent is extended or adjusted under 35 U.S.C. 154(b) by 149 days.

(21) Appl. No.: 18/853,091

(22) PCT Filed: Mar. 28, 2023

(86) PCT No.: PCT/EP2023/057985
§ 371 (c)(1),
(2) Date: Sep. 30, 2024

(87) PCT Pub. No.: WO2023/186882
PCT Pub. Date: Oct. 5, 2023

(65) Prior Publication Data

US 2025/0215695 A1 Jul. 3, 2025

(30) Foreign Application Priority Data

Mar. 30, 2022 (FR) ..... 2202852

(51) Int. Cl.
*E04F 11/18* (2006.01)

(52) U.S. Cl.
CPC ..... *E04F 11/1817* (2013.01); *E04F 11/1853* (2013.01); *E04F 2011/1831* (2013.01)

(58) Field of Classification Search
CPC ..... E04F 11/1812; E04F 11/1817; E04F 11/1851; E04F 11/1853; E04F 2011/1831;
(Continued)

(56) References Cited

U.S. PATENT DOCUMENTS 4,054,268 A * 10/1977 Sher ..... E04F 11/1853 256/24
6,419,209 B1 * 7/2002 Shepherd ..... E04F 11/1853 256/24

(Continued)

FOREIGN PATENT DOCUMENTS

CH 709 045 6/2015
DE 20 2017100181 3/2017

(Continued)

OTHER PUBLICATIONS

International Search Report dated Jun. 19, 2023 for application PCT/EP2023/057985.

*Primary Examiner* — Josh Skroupa
(74) *Attorney, Agent, or Firm* — IPSILON USA, LLP

(57) ABSTRACT

A post for securing a panel (1) includes a base (5), having two faces (5*a*, 5*b*) which are substantially orthogonal with respect to each other. The base has one face (5*a*) which is parallel to the plane of the panel (1), having a linear compression seal (13) at its free end, and one face (5*b*) which is orthogonal to the plane of the panel (1). The base has a flap (7), articulated with respect to the base (5) at the free end of the face (5*b*) which is orthogonal to the plane of the panel (1), carrying a complementary linear compression seal (13) at its end opposite to the articulation (51, 71), and a wedge (9), having an insert (11), inserted at the level of the articulation (51, 71) between the base (5) and the flap (7) in the assembled state which, when inserted, locks articulation (51, 71) in a position clamping the panel (1).

15 Claims, 6 Drawing Sheets

(58) Field of Classification Search
CPC ..... E04F 2011/1889; E04F 2011/1891; E04F 2011/1895; E04H 17/168; E04H 17/17; Y10T 403/7064; Y10T 403/7066
USPC ..... 256/24, 31, 73; 403/374.1, 374.2
See application file for complete search history.

(56) References Cited

U.S. PATENT DOCUMENTS 6,517,056 B2 * 2/2003 Shepherd ..... E04F 11/1853 256/24
9,683,402 B2 * 6/2017 Abdul Lathief .... E04F 11/1853

FOREIGN PATENT DOCUMENTS

DE 102017125020 A1 * 4/2019 ..... E04F 11/1853
GB 2436717 A * 10/2007 ..... E04F 11/1851

* cited by examiner

POST FOR SECURING A PANEL, AND FRENCH-STYLE BALCONY, PRIVACY SCREEN OR SUNSHADE COMPRISING SUCH A POST

RELATED APPLICATION

This application is a National Phase of PCT/EP2023/057985 filed on Mar. 28, 2023, which claims priority to French Patent Application No. 22 02852, filed on Mar. 30, 2022, the entirety of which are incorporated by reference.

FIELD OF THE INVENTION

The present invention relates to the field of construction, and in particular to guardrails with panels such as glass panels. In particular, the invention relates to guardrails for balconies known as French balconies, composed of a single panel attached to a framework of a glazed door, and sunshades comprising a panel which can adopt a variety of orientations, being fixed or capable of being orientated.

Balconies known as French balconies are balconies with a reduced surface area, essentially composed of a glazed door with the masonry forming the framework of said glazed door, and a panel forming a guardrail, attached to the framework of said glazed door.

They offer consumers the possibility of taking advantage of the outdoors with a minimum of construction, in particular without the need for a huge amount of construction work, because a floor slab does not have to be poured, and nor does an extension forming a floor have to be built. It is merely necessary to secure the panel forming the guardrail to the framework.

Sunshades are constructions disposed in front of windows and other openings. They comprise a panel which at least partially stops the sun's rays, for example by reflecting or absorbing the infrared region of the spectrum.

They can be used to improve the management of temperature in a building in a passive manner, without having to resort to air conditioning, or using air conditioning to a lesser extent.

PRIOR ART

In particular, panels which are secured directly to the wall are known, in which the panel passes laterally beyond the framework of the door or window in front of which the French balcony is constructed.

The panels are pre-apertured, for example, and screws hold them against the wall, in which dowels, for example, cooperate with the screws to form a fastener.

Balconies with lateral posts are also known, which comprise vertical posts on each side of the panel. In addition to their function as a mechanical connection between the wall and the panel, the posts may also have an aesthetic purpose.

The posts can in particular be employed to select between French balconies which are known as "surface-mounted", where the panel is in front of the wall and extends laterally beyond the framework of the door or window, and balconies which are known as "panel-mounted", where the panel is contained in the framework of the door or window.

In a "panel-mounted" balcony, the screws are coplanar with the panel and therefore require a supplemental element in order to secure it to the wall. This supplemental element, which acts as a connection between the panel and the wall, is the lateral post for each side of the panel.

French balconies with posts are generally mounted in several steps, in particular with a first step for securing the posts to the wall, then a second step for securing the panel to the posts.

Because the balconies can in particular be installed at height, one or more storeys above the ground, manipulation and securing of the panel has to be carried out with the utmost care and attention in order to prevent it from falling, which is potentially dangerous.

In general, the posts have a wall securing means, in the form of apertures and screws cooperating with dowels in the wall, and a clamping means, in order to ensure positioning of the panel.

The wall securing means is generally put into position before positioning and securing the panel using the clamping means. As an example, balconies are known in which the posts have a U-shaped section, in which the screws attached to the wall are at the bottom of the U. Seals are interposed between the arms of the U and the panel which they are clamping. Because the seals are compressed on insertion, they then hold the panel in a statically indeterminate manner.

The panels are generally heavy and cumbersome, which complicates manipulating them.

As a consequence, there is a risk that the panel will fall when it is put into position but the clamping means has not yet been clamped, or during the definitive securing of the panel. If the balcony is at a height, a falling panel could be highly dangerous for people underneath it, and the panel could also break.

The document CH709045 describes, for example, a large variety of means for securing a panel to a post which could be suitable for balconies. However, the embodiments in that document employ screws which have to be tightened from the outside of the balcony.

The document DE202017100180 describes a French balcony in which the panel is secured by inserting it between two deformable polymer seals which are compressed during said insertion. Thus, insertion of the panel is carried out under load, which necessitates manipulating the panel using force, and therefore increases the probability of the panel accidentally being dropped.

The same problems are encountered in the case of sunshades, in which the posts are horizontal, and connect the panel to a hinge or a base which is movable in rotation.

Thus, there is a need for a post for a balcony known as a French balcony and/or for a sunshade, which can be installed both safely and easily. A post of this type must also be strong and durable in order not to compromise the safety of users.

OBJECTS AND SUMMARY

To meet this need, the invention proposes a post for securing a panel, comprising:

- a base, having two faces which are substantially orthogonal with respect to each other, including:
  - one face which is parallel to the plane of the panel, having a linear compression seal at its free end, and
  - one face which is orthogonal to the plane of the panel,
- a flap, articulated with respect to the base at the free end of the face which is orthogonal to the plane of the panel, carrying a complementary linear compression seal at its free end, the linear compression seals compressing a panel clamped between the base and the flap in the assembled state,
- a wedge, having an insert, inserted at the level of the articulation between the base and the flap in the assembled state which, when inserted, locks said articulation in a position clamping the panel.

Locking the flap with the wedge which, once locked, clamps and holds the panel, means that installation is more rapid and simpler.

The articulation may be composed of a curved return at the free end of the face which is orthogonal to the plane of the panel of the base, and a curved return on the flap, the two curved returns being interlinked during assembly.

Advantageously, the wedge comprises a finger with a triangular section, and a compressible insert, with a V-shaped section, surrounding the triangular-section finger and under compressive strain when inserted at the level of the articulation, and snap-fitting means, snap-fitted with the flap and/or the base when the wedge locks the articulation.

The compressible insert, with end linear seals, holds the panel in a statically indeterminate manner.

The wedge may comprise a decorative façade, at least partially covering the external partition walls of the post when the wedge is inserted.

The post may comprise a bottom having a protuberance with an inclined face, orientated towards the exterior of the façade and a stop surface which is orientated towards the interior of the façade, and the flap then comprises an edge which comes into engagement with the stop surface of the protuberance when the panel is clamped between the flap and the base.

The bottom may have tabs and the base may have rails in which the tabs are engaged in the assembled state, the post then comprising apertures and screws for securing the bottom.

The bottom may have a protrusion against which the narrow edge of the panel will come to bear when it is secured in the post.

Said protrusion may in particular comprise a means for securing a compression seal for the bottom, and the bottom then advantageously further comprises a bottom compression seal inserted into the securing means.

This bottom compression seal may in particular comprise a sole plate produced from a polymeric material at its end in contact with the bottom, inserted into a recess in the bottom in the assembled state, and against which the panel comes to bear when installed.

The base may comprise securing apertures on at least one of the faces, and in particular on both faces.

The base and the flap are advantageously produced by extruding metal.

The invention also concerns a balcony, in particular of the French balcony type, and a sunshade which comprise at least one post as mentioned and a panel clamped between the flap and the base by the post.

BRIEF DESCRIPTION OF THE FIGURES

Further characteristics and advantages of the mount in accordance with the invention will become apparent from the detailed description below of the figures, in which.

The embodiments shown are given by way of illustrative and non-limiting examples. Other embodiments can be derived directly from them by minor modifications and by combining different embodiments.

DETAILED DESCRIPTION OF THE FIGURES

Figure 1:
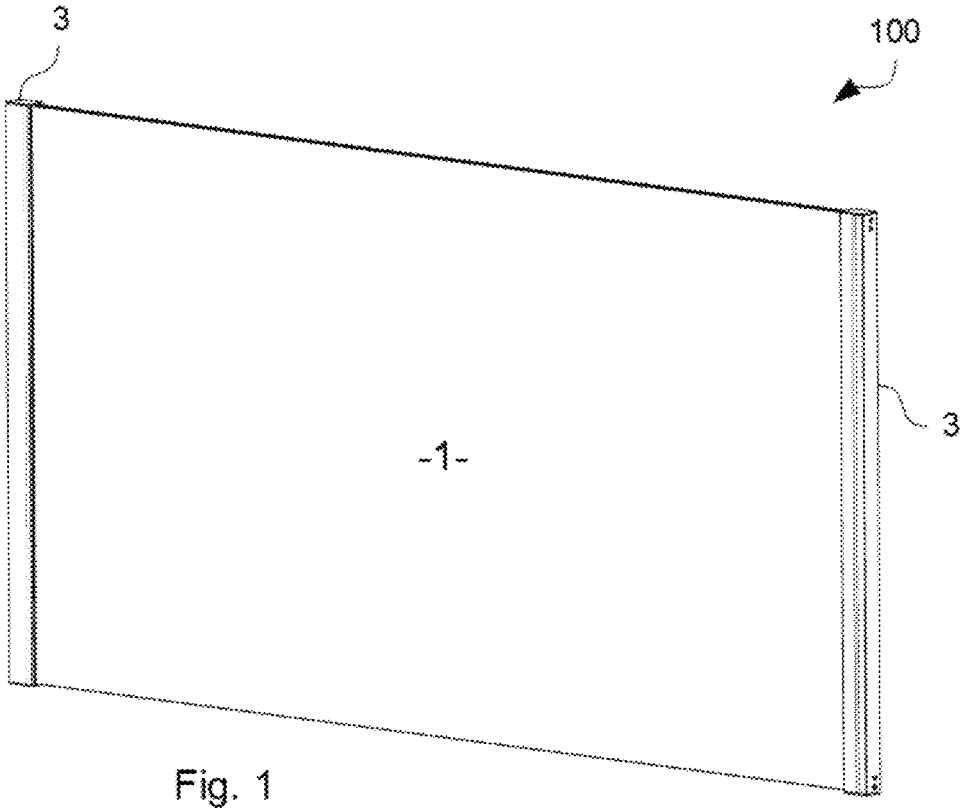
FIG. 1 is a perspective view of a French balcony provided with a guardrail in accordance with the invention.

FIG. 1 is a perspective view of a balcony 100, in particular of the "French" type. The balcony 100 in particular comprises a panel 1, and two posts 3, which are vertical and located either side of the panel 1.

The posts 3 are engaged with the panel 1, which they hold in place.

The panel 1 is, for example, a panel produced from tempered glass, in particular produced in the form of a stack of panes of tempered glass, with interposed layers of plastic material.

As an alternative, the panel 1 may be produced from laminated glass, from a single pane of tempered glass, from cut stone or from metal. In particular, the panel 1 may comprise screen printed layers, printed layers and/or layers forming a screen for incident light.

For the purposes of orientation, the narrow edge of the panel 1 provides a direction which is considered to be longitudinal, the posts 3 and the end of the panel 1 provide a direction which is considered to be vertical (even though the final orientation of the panel 1 can vary, in particular if the façade is inclined), and the third direction, which is considered to be the transverse direction, corresponds to the thickness of the panel 1.

Unless indicated otherwise, the term "plane of the panel 1" as used here means the plane of the face or flat of the panel 1.

In the transverse direction, the "interior" or "towards the interior" is considered to mean the direction orientated towards the interior of the building to which the balcony 100 is affixed, and the opposite direction, orientated towards the exterior of the building, is considered to be "exterior" or "towards the exterior".

Figure 2:
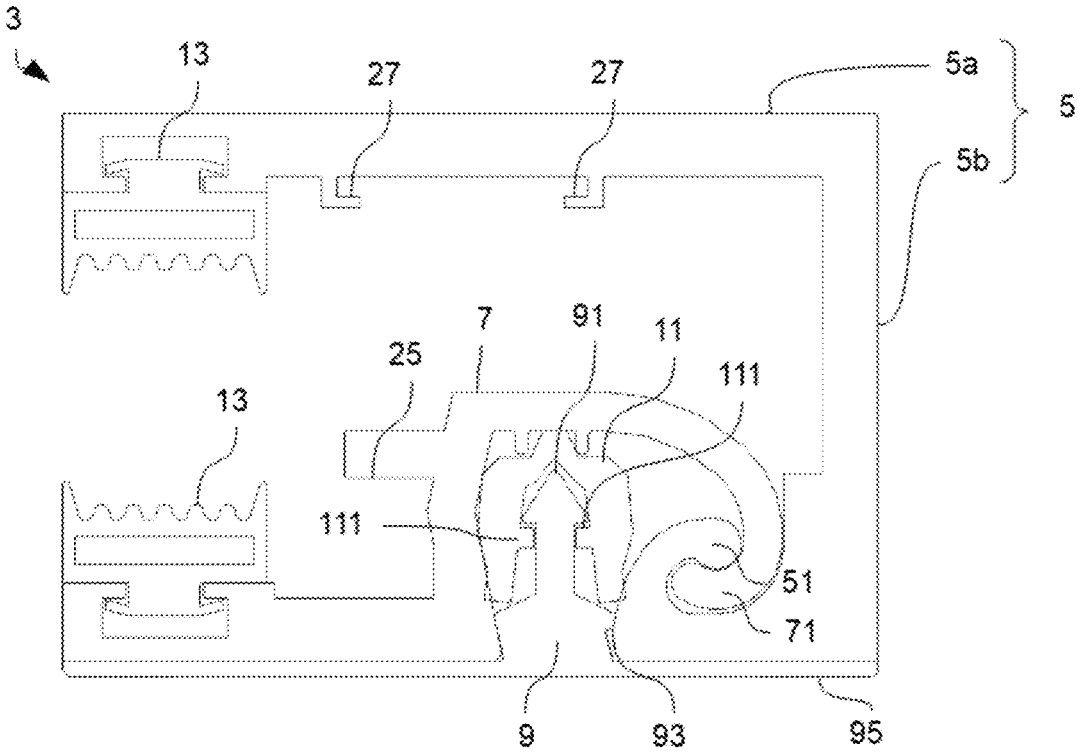
FIG. 2 is a sectional view of a balcony post of FIG. 1.

FIG. 2 is a sectional view of a post 3 in a horizontal plane.

The post 3 comprises a base 5 and a flap 7, articulated on the base 5. The base 5 and the flap 7 are in particular produced in the form of profiles, in particular extrudates. The profile shown in section in FIG. 2 is therefore substantially identical over the entire height of the post 3.

The base 5 has two faces, one, 5*a*, being parallel to the panel 1 and to the façade, the other, 5*b*, being perpendicular to the first and therefore to the panel 1 and to the façade.

The base 5 and the flap 7 are articulated between them by an articulation composed of a curved return 51 at the free end of the face 5*b* which is perpendicular to the plane of the panel 1 and a curved return 71 at the flap 7, the two curved returns 51, 71 being interlinked.

Such articulations are known as "Yoder" type articulations and are used in the automobile sector.

In particular, the curved returns 51, 71 are formed such that the flap 7 can open towards the exterior, in particular with an angle of opening of more than 15° and further with a maximum angle of more than 80°. The curved returns 51, 71 are also shaped in a manner such that the flap 7 can be recessed towards the interior, in particular with a reduced angle of rotation, of the order of 5° to 10°. The curved returns 51, 71 terminate in bulges which come into mutual engagement or engage with a partition wall of the other curved return 51, 71 when a maximum deflection has been reached.

In the assembled state of the post 3, a wedge 9 is inserted between the flap 7 and the base 5, in a manner such as to lock the articulation 51, 71 between the flap 7 and the base 5. In particular, when inserted, the wedge 9 prevents opening of the flap 7 beyond the inclination in which it has an exterior surface which is substantially parallel to the plane of the flat of the panel 1.

More generally, the flap 7 can open towards the exterior in a manner which is sufficient to allow insertion of the panel 1 from the front, and towards the interior in a manner which is sufficient to enable the insertion and snap-fitting of the wedge 9.

In particular, the wedge 9 has a finger 91 with a triangular section, in particular in this case in the form of an arrow pointing towards the interior, and a compressible insert 11, with a V-shaped section, into which the finger 91 of the wedge 9 is inserted.

Other shapes for the end of the finger 91, for example semi-circular or elliptical, trapezoidal, etc. may of course be envisaged.

The compressible insert 11 is compressed between the flap 7 and the base 5 when the flap 7 is substantially parallel to the plane of the flat of the panel 1, and then tends to incline the flap 7 towards the interior by its elastic recoil.

In the absence of the finger 91 of the wedge 9, the compressible insert 11 may in particular be closed and more easily compressed by the flap 7, which opens towards the exterior.

Advantageously, the compressible insert 11 has two saw teeth 111 on the interior surfaces of the V-shaped section. These saw teeth 111 come into engagement with the edges of the finger 91 of the wedge 9, and the flap 7 has a notch into which the point of the V-shaped section is inserted in the assembled state.

The wedge 9 has snap-fitting means, here in the form of a shoulder 93. The end of flap 7 opposite the articulation 51, 71 and the free end of the face parallel to the façade of the base 5 each comprise a linear compression seal 13. These linear compression seals 13 are, for example, strips of polymeric material and compress the panel 1 in the assembled state.

In particular, the flap 7 and the base 5 have a T-shaped recess into which a rail with a T-shaped section corresponding to the linear compression seals 13 is inserted.

The linear compression seals 13 may alternatively be bonded, screwed or riveted to the base 5 and to the flap 7. These linear compression seals 13 are compressed when the panel 1 is clamped between the flap 7 and the base 5 and the wedge 9 is inserted. Their elastic recoil tends to open the flap 7 towards the exterior, and therefore opposes the action of the compressible insert 11.

The wedge 9 and in particular the compressible insert 11, in combination with the linear compression seals 13, hold the panel 1 in a statically indeterminate manner. In particular, the counteracting actions of these elements can be used to absorb the transverse vibrations and expansion of the panel 1.

Figure 3:
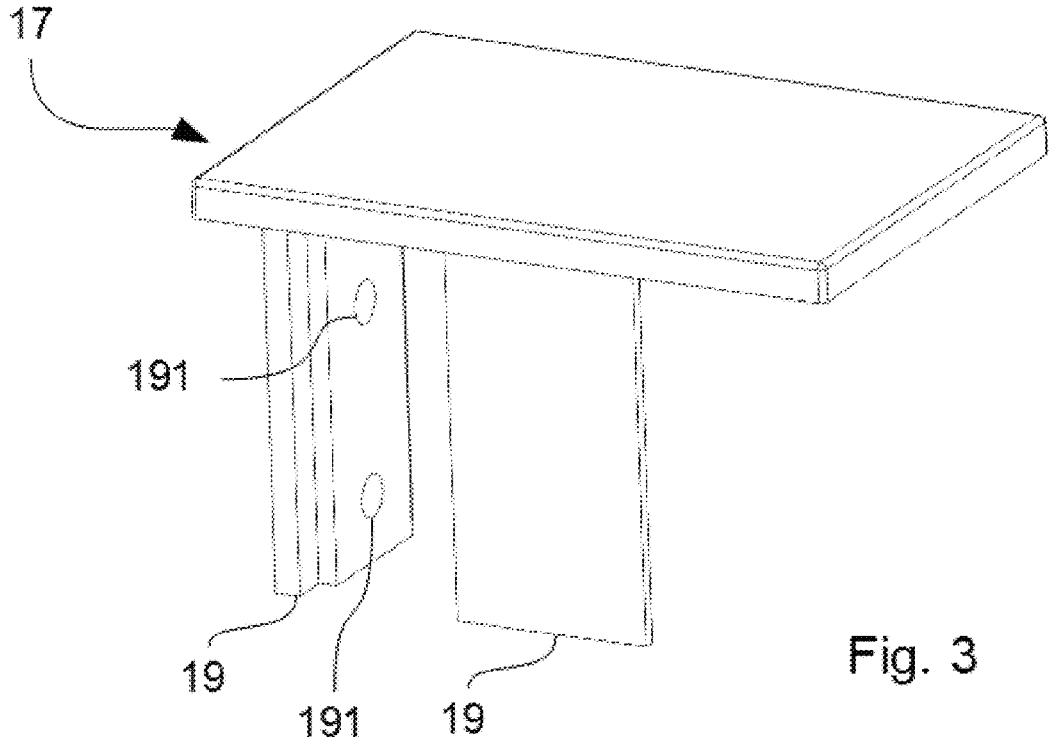
FIG. 3 is a perspective view of a cover for the post of FIG. 2.

FIG. 3 shows a cover 17 which is shaped to close the upper end of the post 3 when it is installed.

The cover 17 in particular comprises two tabs 19 on two perpendicular sides, and at least one of the tabs 19 has apertures 191 which, in the installed state, cooperate with the screws 15 in order to secure the cover 17 to the post 3.

Figure 4:
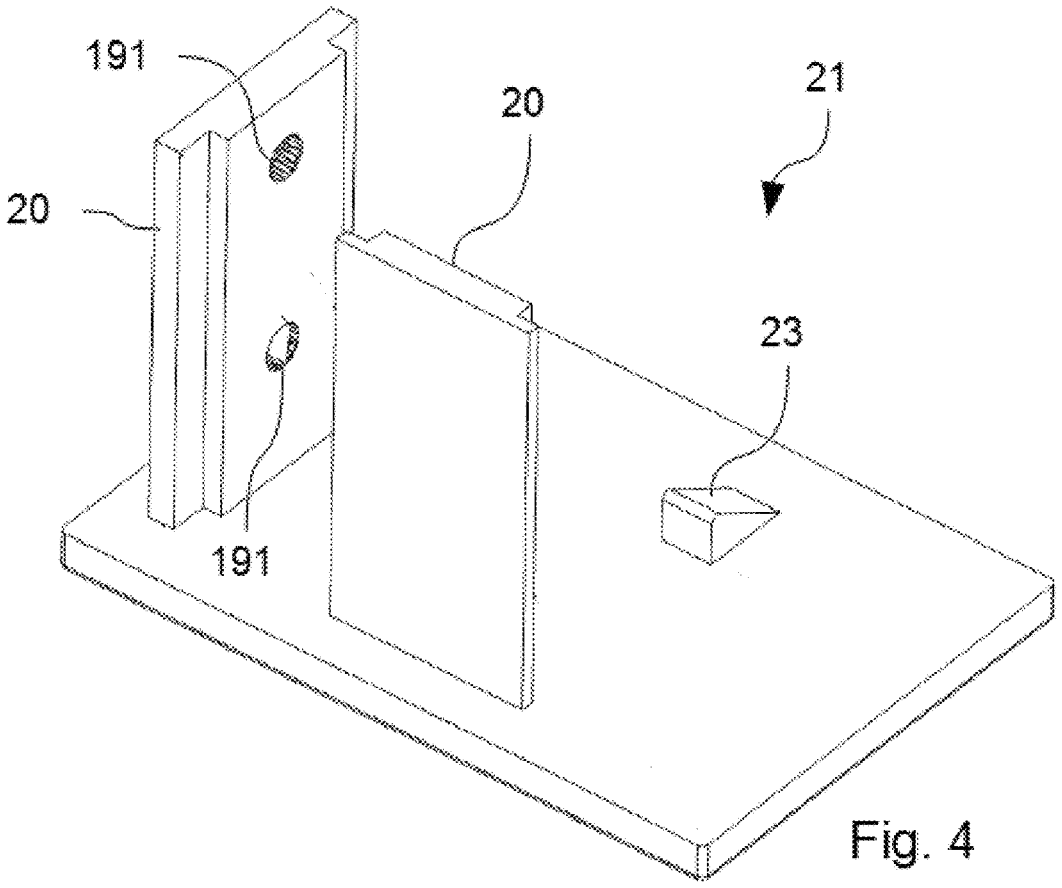
FIG. 4 is a perspective view of a bottom for the post of FIG. 2.

FIG. 4 shows a bottom 21 which is shaped to close the lower end of the post 3 when it is installed.

The bottom 21 also comprises two tabs 20, at least one of which having apertures 191 cooperating with the screws 15 in the installed state.

The bottom 21 has a protuberance 23 with a triangular section, with an inclined face orientated towards the exterior and a stop surface, with is substantially vertical, orientated towards the interior of the façade. The stop surface maintains the flap 7 in the closed position in the assembled state.

Figure 5:
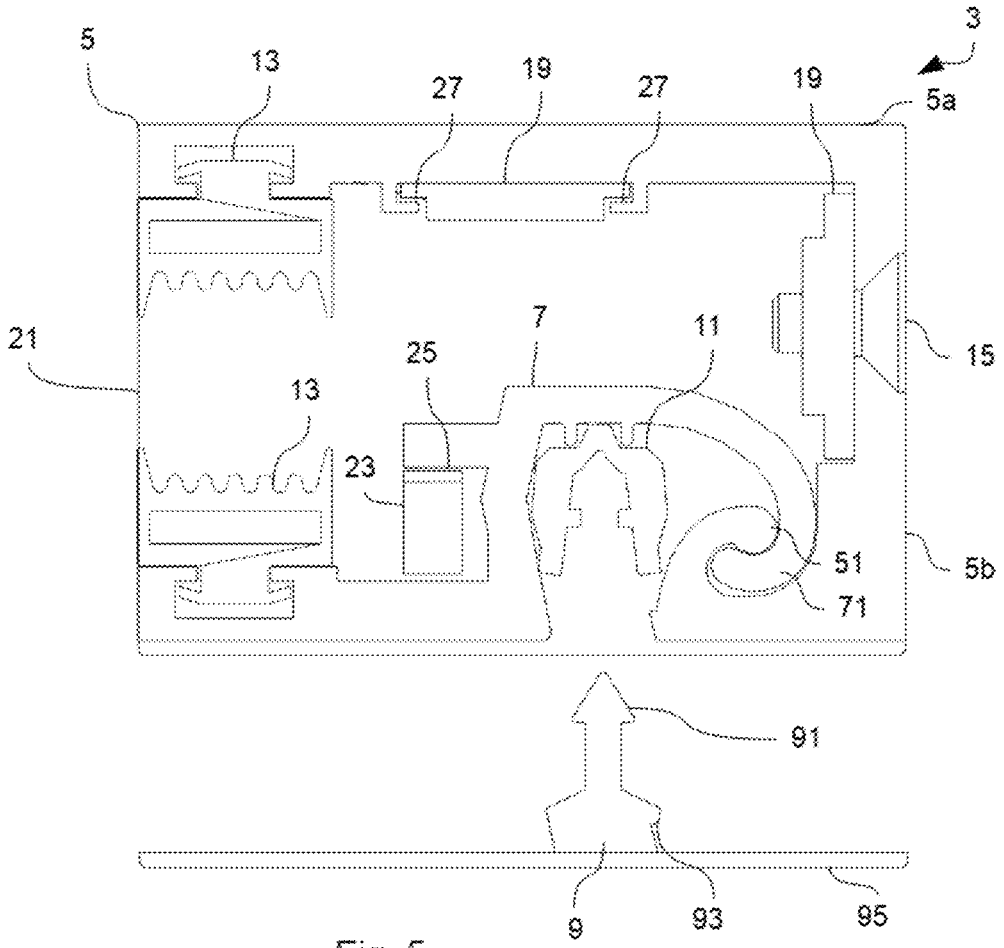
FIG. 5 is a top view of the post of FIG. 2 during assembly.

FIG. 5 shows a sectional top view of a bottom 21 engaged with the flap 7 and the base 5.

The flap 7 comprises an edge 25 which comes into engagement with the stop surface of the protuberance 23 when the panel is clamped between the flap 7 and the base 5.

In the embodiment shown, the edge 25 is carried by a protrusion of the flap 7, the protrusion being longitudinal.

The base 5 in particular comprises rails 27 into which the tabs 19, 20 of the cover 17 and the bottom 21 are inserted. The face which is perpendicular to the flat of the panel 1 of the base 5 comprises apertures into which screws 15 are inserted.

The screws 15 inserted into the apertures 191 of the tabs 19, 20 and the base 5 secure the cover 17 and the bottom 21.

Supplemental apertures are in particular provided in order to secure the posts on the wall, for example by means of screws and dowels.

In FIG. 5, the wedge 9 is being inserted between the base 5 and the flap 7. In particular, the wedge 9 can be seen to be set back with respect to its positioning in the assembled state. The wedge 9 comprises a decorative façade 95 which extends from the base of the wedge 9, opposite to the finger 91.

When the wedge 9 has been inserted, the decorative façade 95 covers the exposed surface of the base 5 and the flap 7 and therefore covers the exposed surface of the post 3. The decorative façade 95 may be produced from another material with a different finish or be covered with a decorative layer.

In the embodiment shown, the decorative façade 95 covers the front surface externally and parallel to the plane of the panel 1. In alternative embodiments, the decorative façade 95 may also cover the lateral exterior face of the post 3.

In particular, the fact that the wedge 9 carries a decorative façade 95 implies that the other elements, namely the base 5 and flap 7, may be identical and produced from materials selected for their strength and their durability. In particular, the bases 5 and flap 7 may be produced by extrusion, in aluminium or stainless steel.

Only the wedge 9 or at least the decorative façade 95 then has to be produced from a decorative material or have a decorative finish.

Figure 6:
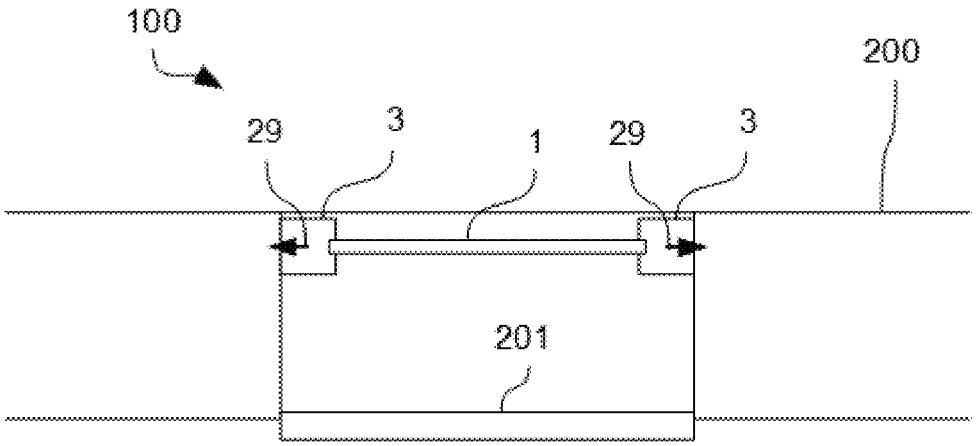
FIG. 6 is a sectional view of a panel-mounted French balcony.
Figure 7:
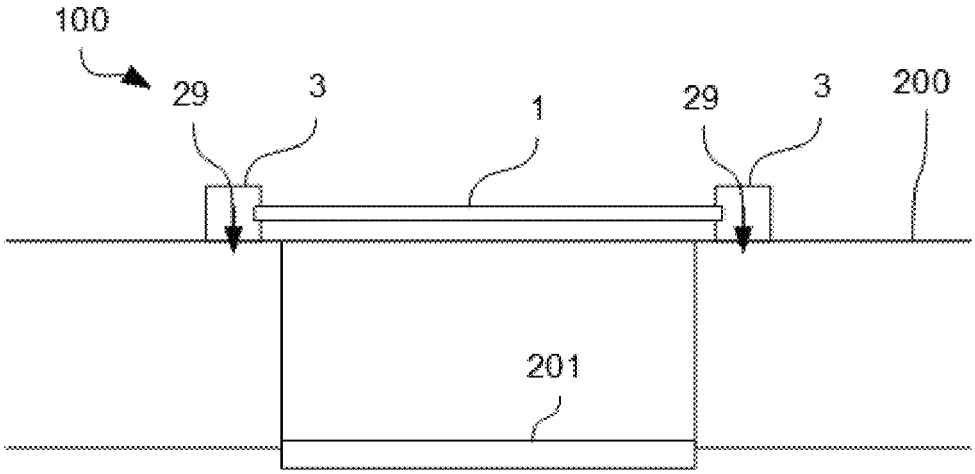
FIG. 7 is a sectional view of a surface-mounted French balcony.

FIGS. 6 and 7 illustrate the two manners of mounting the balcony 100 on a wall 200. Here, the wall 200 is apertured by a window 201 the framework of which is partially closed once the balcony 100 is in position.

In FIG. 6, the balcony 100 is installed in a panel-mounted manner: the posts 3 are installed in the framework of the window 201, on the transverse partition walls of the framework.

The posts 3 are then secured by securing means 29, for example screws and dowels, which are orientated parallel to the façade.

Panel mounting means that the balcony 100 does not go beyond the wall 200.

In FIG. 7, the balcony 100 is mounted in a surface-mounted manner: the posts 3 are installed on the exterior partition wall of the wall 200, either side of the framework of the window 201.

The posts 3 are then secured by securing means 29 which are orthogonal to the façade as regards their orientation.

Surface mounting maximizes the surface area of the balcony 100, but this implies that the posts 3 and the panel 1 are suspended beyond the framework and the wall 200.

The base 5 of the posts 3 comprises securing apertures, for example, which are not shown, which cooperate with the securing means 29.

For panel mounting, said securing apertures are, for example, disposed on the face 5*b* which is perpendicular to the façade of the base 5. For surface mounting, the securing apertures are advantageously formed in the face 5*a* which is parallel to the façade.

For economical and logistical reasons, it is in particular possible to produce the securing apertures on the two faces 5*a*, 5*b* of the base 5. The same base 5 may then act both for panel mounting and for surface mounting.

The assembly of the balcony 100 in accordance with the invention is therefore quick and easy.

The first step is securing the bases 5 to the wall 200, for example by means of dowels and screws.

The bottom 21 is then put into position and secured to the corresponding base 5 by means of screws 15.

The flap 7 is then put into position by translation from the top, interlinking its curved return 71 with the curved return 51 of the base 5. The "Yoder" type articulation in particular enables this insertion by translation to be carried out. The bottom 21 then forms an abutment to the insertion of the flap 7.

The flap 7 is then moved into its open position, orientated towards the exterior. The panel 1 can then be put into position and the flap 7 brought into the closed position.

During closure of the flap 7, its edge 25 comes into engagement with the protuberance 23. In the direction of closing, the inclined face of said protuberance 23 will lift the flap 7, which can be translated upwards. When the flap 7 reaches the closed position, the edge 25 reaches the point of the protuberance 23 and the flap 7 is translated downwards under gravity. The edge 25 is then in engagement with the substantially vertical stop surface, and the return movement of the flap 7 is prevented in the absence of an upwards movement.

The panel 1 is therefore held temporarily.

The wedge 9 is then inserted, as well as the compressible insert 11, until the shoulder 93 of the wedge 9 has snap-fitted with the flap 7 or the base 5. The insertion of the wedge 9 locks the flap 7 in the closed position.

The cover 17 is then put into position at the upper end and secured by means of a screw 15 and the rails 27, in the same manner as the bottom 21.

Temporarily holding the panel 1 in the posts 3 by the edge 25 and the protuberance 23 contributes to safety during installation. This temporary hold means, for example, that the panel 1 can be released so that the wedges 9 and compressible inserts 11 can be fetched.

Figure 8:
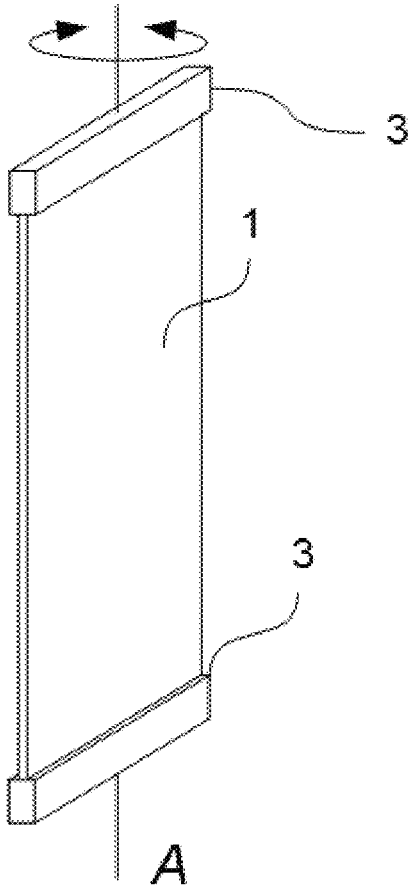
FIG. 8 is a diagrammatic perspective view of a sunshade.

FIG. 8 is a diagrammatic perspective representation of a sunshade 300 using posts 3 as described above.

These posts 3 clamp a panel 1, for example produced from active glass, or glass which filters part of the spectrum of the light passing through it.

The posts 3 here are horizontal, and secure the panel 1 to a mechanism for rotating the axis of rotation A, which is vertical. The panel 1 can turn about said axis of rotation A in a manner such that it can be orientated parallel to incident solar radiation when it does not have to be stopped or filtered by the panel 1, or orthogonally to the sun's rays when a large part of the solar radiation has to be stopped or filtered.

The shape of the elements composing the posts 3 is unchanged; only the orientation with respect to gravity (horizontal disposition instead of vertical disposition) and with respect to the façade 200 (rotation about the axis of rotation A) is changed.

Figure 9:
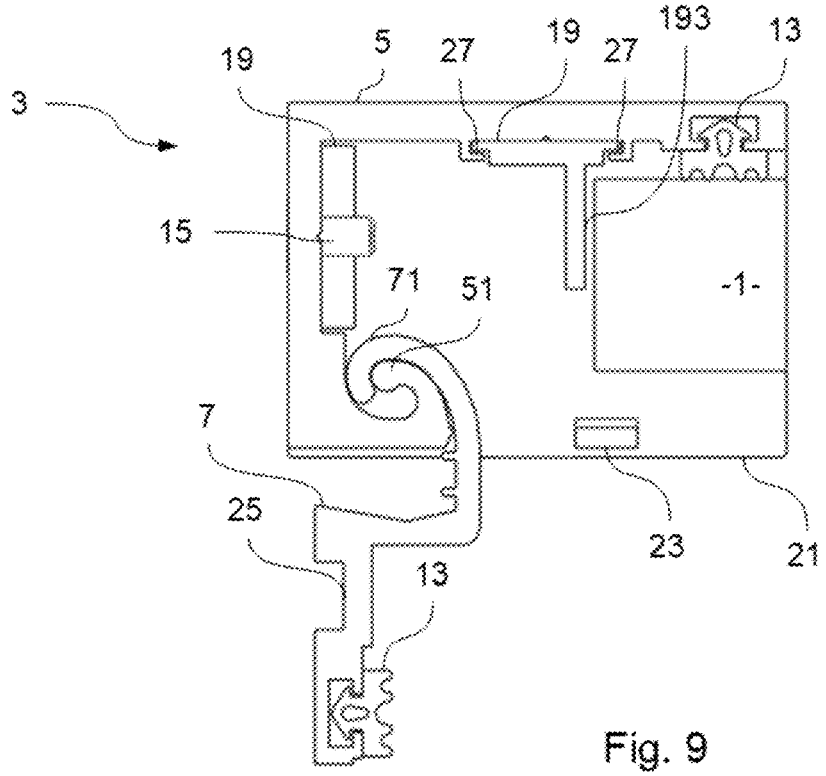
FIG. 9 is a sectional view of an alternative embodiment of a post.

FIG. 9 is a sectional view of an alternative embodiment of a post 3. In FIG. 9, the flap 7 is shown in the open position, with an angle of rotation of approximately 90°, and therefore a transverse orientation.

In this embodiment, the edge 25 is carried by a recess in the longitudinal front wall of the flap 7, and as a consequence, the protuberance 23 is disposed close to the exterior or front longitudinal border of the bottom 21.

The recess carrying the edge 25 is covered by the decorative façade 95 of the wedge 9 in the installed state (not shown in FIG. 9).

One of the tabs 19 of the bottom 21 (and optionally of the cover 17) has a protrusion 193 forming a longitudinal abutment of the panel 1. The protrusion 193 is in particular transverse and planar in the assembled state.

The bottom 21 and the cover 17 are implemented. Thus, in the case of longitudinal translation, the panel 1 then comes into abutment against the protrusion 193 parallel to the end of the panel 1. The panel 1 then bears against the protrusion with an extensive bearing surface, which reduces the risks of fracture or breakage of the panel 1.

In fact, a longitudinal play of the panel 1 in the posts 3 is required so that it can expand in this direction. A play also results which can reduce the dimensional stresses in the panel 1 and during positioning of the posts 3 on the wall 200.

Figure 10:
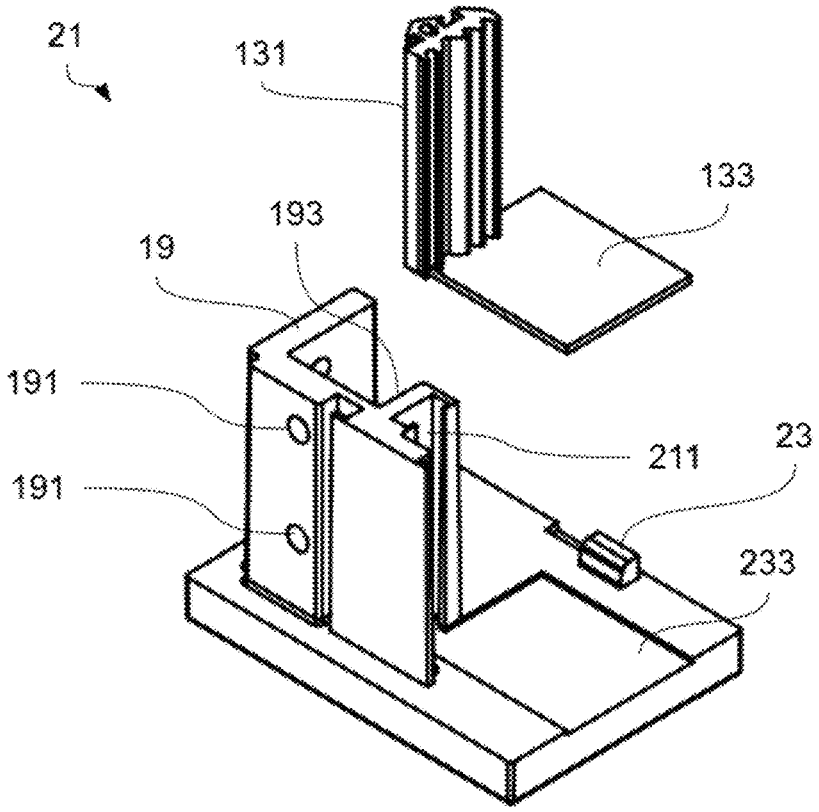
FIG. 10 is a partial perspective view of a supplemental embodiment of a bottom for the post.

FIG. 10 illustrates a supplemental embodiment of the bottom 21 for the post 3 of balcony 100.

On the protrusion 193 of one of its tabs 19 forming an abutment for the narrow edge of the panel 1, the bottom 21 of FIG. 10 comprises a rail 211 by means of which a compression seal 131 for the bottom is secured.

The bottom compression seal 131 is similar to the compression seals at the free ends of the base 5 and the flap 7. It is produced from a compressible polymeric material.

At its end bearing against the bottom 21, the bottom compression seal 131 comprises a substantially planar sole plate 133, formed as one piece with the bottom compression seal 131. When the bottom compression seal 131 is inserted into the rail 211, the sole plate 133 is contained in a recess 233 with a shape corresponding to the horizontal wall of the bottom 21.

Figure 11:
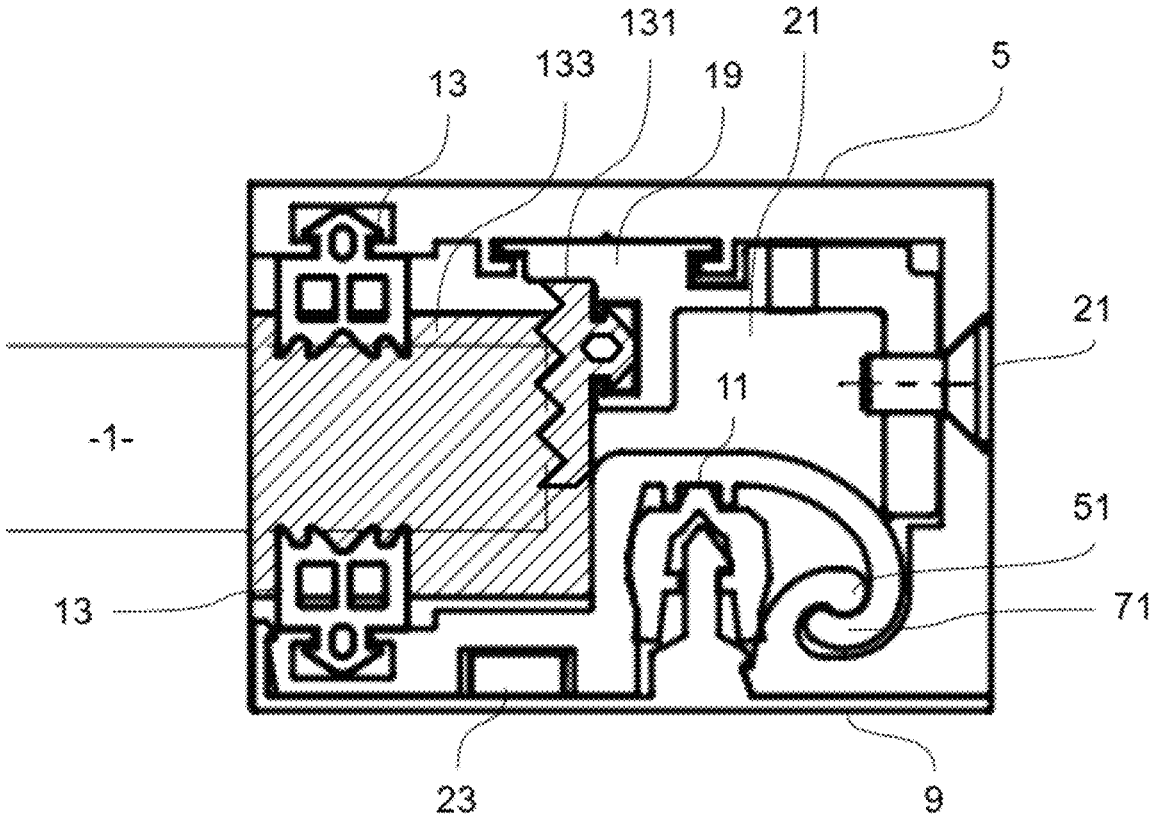
FIG. 11 is a sectional top view of a post incorporating a bottom of FIG. 10.

FIG. 11 shows the bottom 21 of FIG. 10 installed in a post 3 and with a panel 1, shown in part, engaged with said post 3.

It can be seen in FIG. 11 that the panel 1 is bearing against the two compression seals 13 of the base 5 and the flap 7, against the bottom compression seal 131 at its narrow edge, and against the sole plate 133 at its lower face.

The panel 1 is therefore only in contact with the polymeric elements linked to the compression seals 13, 131 and therefore does not have any contact with the metallic material of the post 3. The probability of breakage of the panel 1 is therefore reduced, in particular by fatigue due to an accumulation of microfractures due to vibrations transmitted by the metal of the post 3 to the panel 1.

Because the panels 1 are generally heavy (tens or even hundreds of kilograms), they are not easy to manipulate, and are potentially prone to accidents. Securing by insertion of the wedge 9 means that the steps which are necessary when securing a panel 1 can be reduced. Holding it temporarily by means of the protuberance 23 can further minimize the manipulation of the panels 1, which only have to be put into position once.

Installation of a balcony 100 or sunshade 300 with the posts 3 in accordance with the invention also involves fewer screws, and no apertures are made in the panel 1.

The invention claimed is:

1. A post for securing a panel, comprising:

a base, having two faces which are substantially orthogonal with respect to each other, including:

one face which is configured to be parallel to the plane of the panel, having a linear compression seal at its free end, and one face which is configured to be orthogonal to the plane of the panel, a flap, articulated with respect to the base at the free end of the face which is orthogonal to the plane of the panel, carrying a complementary linear compression seal at its end opposite to the articulation, the linear compression seals are configured to compress the panel between the base and the flap in the assembled state, a wedge, having an insert, inserted at the level of the articulation between the base and the flap in the assembled state which, when inserted, locks said articulation in a position clamping the panel, wherein the wedge comprises snap-fitting means, snap-fitted with the flap and/or the base when the wedge locks the articulation.

2. The post as claimed in claim 1, wherein the articulation is composed of a curved return at the free end of the face which is orthogonal to the plane of the panel of the base, and a curved return on the flap, the two curved returns being interlinked during assembly.

3. The post as claimed in claim 1, wherein the wedge comprises a finger and the insert is a compressible insert surrounding the finger, with a triangular section, and under compressive strain when inserted at the level of the articulation.

4. The post as claimed in claim 3, wherein the finger comprises a triangular section, and the compressible insert comprises a V-shaped section.

5. The post as claimed in claim 1, wherein the wedge comprises a decorative façade, at least partially covering the external partition walls of the post when the wedge is inserted.

6. The post as claimed in claim 1, wherein the post comprises a bottom having a protuberance with a stop surface which is orientated towards the interior of the façade, and in that the flap comprises an edge which comes into engagement with the stop surface of the protuberance when the panel is clamped between the flap and the base.

7. The post as claimed in claim 6, wherein the bottom has a protrusion against which the narrow edge of the panel will come to bear when it is secured in the post.

8. The post as claimed in claim 7, wherein the protrusion comprises a means for securing a compression seal for the bottom, and in that the post further comprises a bottom compression seal inserted into the securing means.

9. The post as claimed in claim 8, wherein the bottom compression seal further comprises a sole plate produced from a polymeric material at its end in contact with the bottom, inserted into a recess in the bottom in the assembled state, and against which the panel comes to bear when installed.

10. The post as claimed in claim 1, wherein the bottom has tabs and the base has rails in which the tabs are engaged in the assembled state, and in that it comprises apertures and screws for securing the bottom.

11. The post as claimed in claim 1, wherein the base comprises securing apertures on at least one of the faces.

12. The post as claimed in claim 1, wherein the base comprises securing apertures on both faces.

13. The post as claimed in claim 1, wherein the base and the flap are produced by extruding metal.

14. A balcony, including a balcony selected from various types including a French type, wherein said balcony comprises at least one post as claimed in claim 1 and a panel clamped by the post between the flap and the base.

15. A sunshade, comprises at least one post as claimed in claim 1 and a panel clamped by the post between the flap and the base.

* * * * *